United States Patent [19]

Walker et al.

[11] Patent Number: 4,962,406

[45] Date of Patent: Oct. 9, 1990

[54] COMPACT DC/AC CIRCUIT BREAKER WITH COMMON ARC EXTINGUISHING CAPABILITY

[75] Inventors: Roger E. Walker, Franklin Township, Beaver County; Richard J. Pentz, Beaver, both of Pa.

[73] Assignee: Westinghouse Electric Corp., Pittsburgh, Pa.

[21] Appl. No.: 457,048

[22] Filed: Dec. 26, 1989

[51] Int. Cl.[5] ..... H01H 9/30

[52] U.S. Cl. ..... 335/201; 335/35; 200/147 R

[58] Field of Search ..... 335/201, 35, 36; 200/144 R, 147 R

[56] References Cited

U.S. PATENT DOCUMENTS

| | | | |
|---|---|---|---|
| 3,254,176 | 5/1966 | Gelzheiser . | |
| 3,566,318 | 2/1971 | Gelzheiser et al. . | |
| 4,266,210 | 5/1981 | Mrenna et al. . | |
| 4,617,546 | 10/1986 | Kellogg et al. | 335/170 |

*Primary Examiner*—Leo P. Picard
*Assistant Examiner*—L. Donovan
*Attorney, Agent, or Firm*—C. M. Lorin

[57] ABSTRACT

A circuit breaker combines DC and AC arc extinguishing capabilities by associating a magnet applied permanently upon the outside wall of the insulating housing of the breaker and a U-shaped member of ferromagnetic material lodged and held inside the housing, both being in line with the centrally disposed arc chamber and the fixed and stationary contacts thereof.

7 Claims, 5 Drawing Sheets

COMPACT DC/AC CIRCUIT BREAKER WITH COMMON ARC EXTINGUISHING CAPABILITY

FIELD OF THE INVENTION

The invention relates to circuit breakers in general, and more particularly to circuit breakers for industrial power circuits, 240 V ratings and high ampere ratings.

BACKGROUND OF THE INVENTION

One of the imperative with a circuit breaker is handling high overload and short circuit currents which involves arc extinguishing features. Shield arrangements have been designed for rapidly extinguishing arcs in circuit breakers with a high current interrupting capability. There is, however, another requirement which is to maintain minimal size requirements and low cost construction. The latter, as shown in U.S. Pat. No. 3,566,318, has been solved in the past with a housing composed of electrically insulating material, such as a thermosetting resin, within which all the sophistication of an effective full capability circuit breaker has been accommodated. One of the major features, so incorporated in a relatively small housing, has been to provide an arc chamber, centered in the plane of the trajectory of the movable contact pulled away from the stationary contact, wherein the arc can stretch out until it breaks. As shown for an AC circuit breaker by U.S. Pat. No. 4,266,210, an improvement thereon has been to provide an U-shaped member of ferromagnetic material (such as steel) aligned with the sidewalls of the housing and defining an inner channel wherein the arc is pulled away and split into smaller arcs by the eddy-currents induced in the U-shaped member. This works only with AC current.

It is also known for DC circuit breakers to use a magnet applying a field to the arc chamber in a direction such as to force the arc away from its shortest trajectory when the movable contact is pulled away from the stationary contact, thereby to help break the arc and allow protection against higher DC currents.

It is desirable to avoid redesigning a circuit breaker for DC usage when it is already available and known on the market for AC applications usage, and conversely. A model which has all the qualities desired in terms of effectiveness, cost, size, insulation, and as available on the market, should preferably be compatible for AC and DC applications in a more general use. Therefore, a circuit breaker has now been designed which can be used for those fields of application and, while so doing, minimal changes have been called for without impairing the commercial quality of the circuit breaker as it is known for either of these two fields of application.

SUMMARY OF THE INVENTION

A circuit breaker is provided including: an insulating housing, separable electrical contacts within the housing and a mechanism for actuating said contacts relative to one another under a command for electrical breaking through the mechanism; the housing having two opposite side-walls and the contacts being centered for relative movement in a central plane parallel to said sidewalls. At least one U-shaped member of ferro-magnetic material is provided, defined by two opposite outer lateral surfaces and two opposite inner lateral surfaces, and disposed within the housing so that the outer lateral surfaces are mounted adjacent to the corresponding sidewalls of the housing and with two inner lateral surfaces symmetrically placed on opposite sides of the central plane, so that the U-shaped member defines about the parallel plane a common arcing region for the arc generated by said contacts when separating. In addition to the U-shaped member so placed inside the housing, the invention provides for at least one magnet mounted outside the housing upon one of the sidewalls, the magnet having a polar area substantially equal to the area laterally projected upon the sidewall by the common arcing region, and the magnet has a polar orientation so selected in relation to the electric arc as to generate across the arcing region a magnetic field effective to have a quenching effect when the circuit breaker is operating under a DC voltage. As a result, the circuit breaker is operable with an AC voltage under the U-shaped member, and with a DC voltage under the magnet.

DESCRIPTION OF THE PREFERRED EMBODIMENT OF THE INVENTION

Figure 1A:
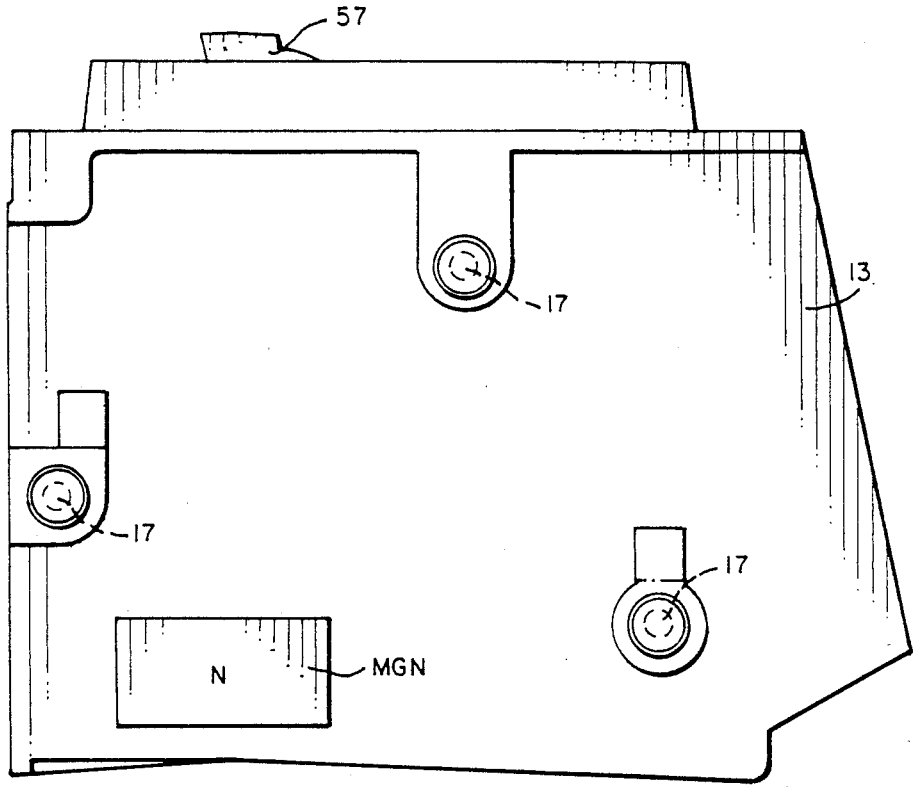
FIGS. 1A and 1B are two different outside views of the housing of the circuit breaker according to the invention.
Figure 1B:
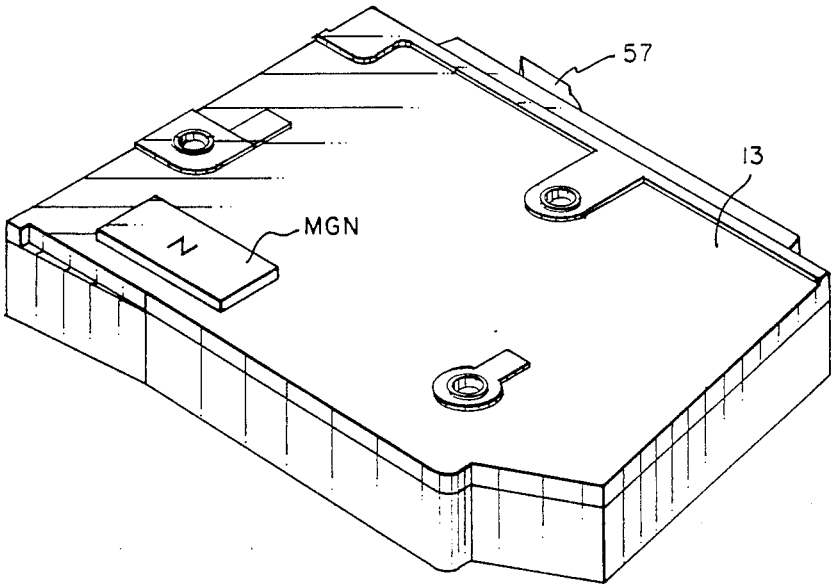

FIGS. 1A and 1B are outside views of the housing of the circuit breaker according to the present invention. In FIG. 1A, the circuit breaker is seen laterally and standing, whereas FIG. 1B gives an asymmetric view of the same. These views are borrowed in part from U.S. Pat. Nos. 4,266,210; 3,566,318 and 3,254,176. For the purpose of a full description of the circuit breaker and its housing, those three patents are hereby incorporated-by-reference.

At 17 are shown the rivets which are used to hold the two parts of the housing together, while maintaining in place therein the breaker mechanism, the stationary and movable contacts, the supporting metal frame the trip device and the line terminals, and forming about the contacts an arc chamber provided with a U-shaped member. The housing is composed of electrically insulating material, such as a thermosetting resin. It includes two molded integral parts defining, when joined together by the rivets, a closed compartment for the circuit breaker parts. One key part of the circuit breaker is the arc chamber where the stationary and movable contacts become spaced apart in a plane centered between the two sidewalls of the housing. The trajectory of the two contacts defines the central plane of the arc chamber spatially. The arc chamber, shown in FIGS. 2, 3 and 4, has an active lateral surface which is projected geometrically onto the sidewall of the housing. According to the present invention, a magnet MGN is glued upon the surface of the housing, covering an area which occupies substantially the entire projection on the sidewall of the active area of the arc chamber. Assuming a specific direction of the DC current between one DC terminal and the other, the magnet is shown with its North polarity side facing outside of the housing, while the South polarity face is at the interface with the wall of the housing upon which it is glued. This determines the direction of the magnetic field applied perpendicularly across the arc chamber it penetrates from the outside, and it matches the direction of the DC current so as to generate an orthogonal force causing the arc to lengthen away from a straight line as it extends across the gap from one contact to the other, as generally known.

Figure 2:
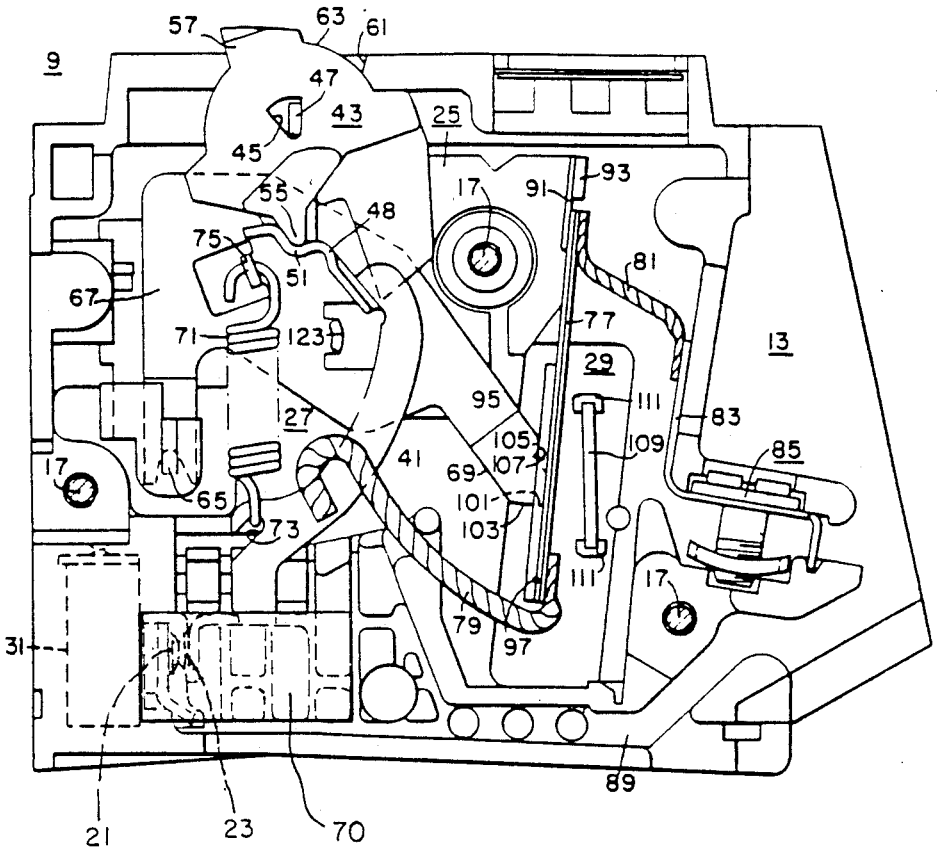
FIG. 2 is a view of the inside of the circuit breaker of FIGS. 1A and 1B showing the arc chamber and a U-shaped member in position in the chamber.

Referring to FIG. 2, the circuit breaker mechanism which is enclosed by the housing comprises a stationary contact 21, a cooperating movable contact 23, a supporting metal frame 25, an operating mechanism 27 and a trip device 29.

Figure 3:
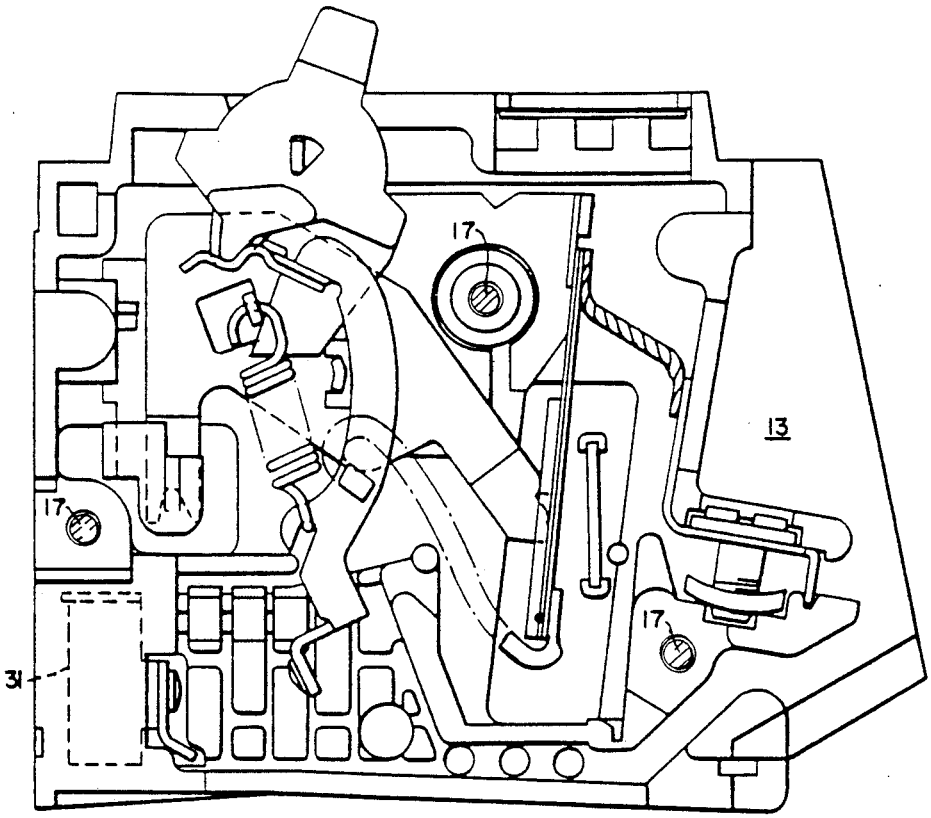
FIGS. 3 and 4 show the inside of the circuit breaker of FIG. 2 without the U-shaped member and with the movable contact at two different distances from the fixed contact within the arc chamber.
Figure 4:
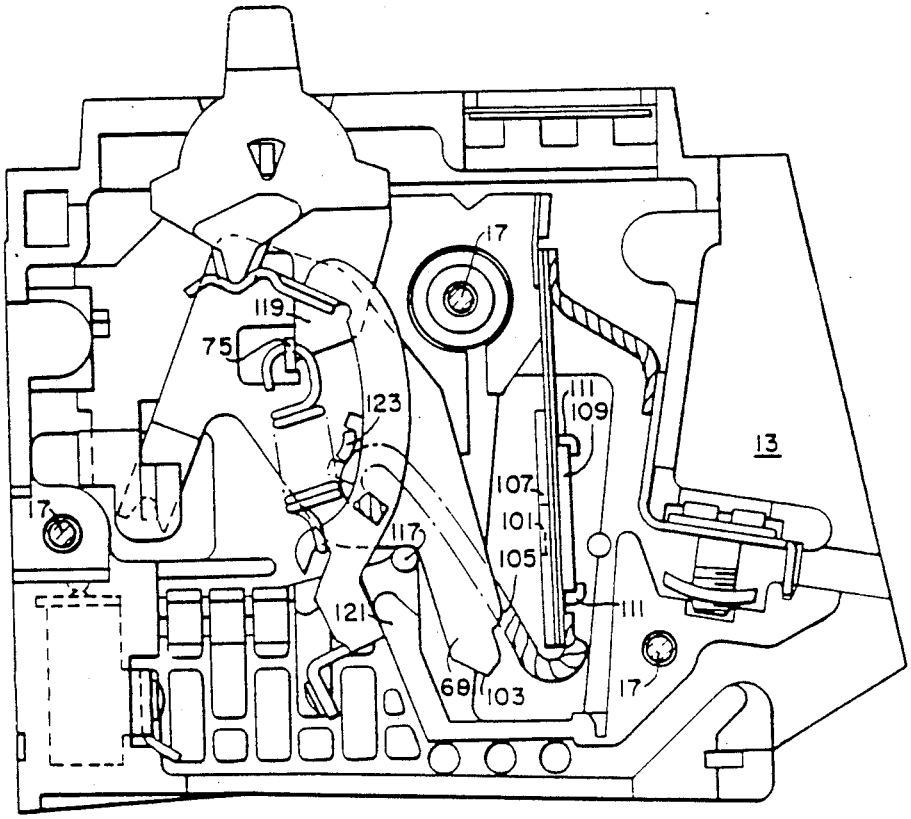

Referring to FIGS. 2–4, the stationary contact 21 cooperates with the movable contact 23 that is welded or otherwise secured to a small flange portion of a flat metallic generally C-shaped contact arm 41. Means for operating the contact arm 41 to the open and closed positions comprises an operating member indicated generally at 43 having a V-shaped opening 45 therein, which opening receives a projection 47 of the stationary metallic frame 25. The operating member 43 is biased outwardly or upward as seen in FIGS. 2–4, to a position wherein the lower edges of the projection 47 pivotally engage the lower side walls of the V-shaped opening 45. The contact arm 41 is bent over at its upper end at 48, and a slot is provided in the part 48. Depressions 51 are formed in the part 48 on opposite sides of the slot. When the parts are in the operating position, a projection molded integral with the operating member 43 extends into the slot of the contact arm 41 to position the operating member 43 relative to the contact arm 41, and pivoting portions 55 on opposite sides of the projection pivotally engage in the depressions 51 of the contact arm 41. The operating member 43 has a handle portion 57 molded integral therewith which extends through an opening 61 in the housing whereby the mechanism may be manually operated to open and close the breaker. Arcuate surfaces 63 on opposite sides of the handle 57 substantially close the openings 61 in all positions of the operating member 43. Motion is transmitted from the operating member 43 to the contact arm 41 when the breaker is manually operated and from the contact arm 41 to the operating member 43 when the breaker is automatically tripped.

The frame 25 supports an insulating pivot 65. A releasable member 67 is pivotally supported at one end thereof on the pivot 65. The other end 69 of the releasable member 67 is latched by the trip device 29.

The ends of the releasable member 67 are offset and disposed along a plane which is parallel to a plane in which the main body portion of the releasable member 67 is disposed. A spring 71 is connected, under tension, at one end in a slot 73 in contact arm 41, and at the other end in a slot in a projection 75 that extends from the main body portion of the releasable member 67.

The contact arm 41 is electrically connected to the lower end of a bimetal 77 by means of a flexible conductor 79. The bimetal 77 is part of the trip device 29. A flexible conductor 81 connects the upper end of the bimetal 77 with a terminal strap 83 that extends through an opening in the end wall of the circuit breaker. A terminal connector 85 is connected to the external end of the terminal strap 83 to permit connection of the circuit breaker in a circuit in a manner well known in the art. The closed circuit through the circuit breaker 9 extends from the terminal 31 through the stationary contact 21, movable contact 23, contact arm 41, flexible conductor 79, current-carrying bimetal 77, flexible conductor 81, terminal strap 83, to a conducting line that would be connected to the terminal, strap 83 by means of the terminal connector 85. Since the movable contact arm 41 extends downwardly from its pivot, the arc is established adjacent the bottom of the housing in an arc chamber 87 which is connected by a vent passage 89 to an opening in the end of the housing beneath the terminal connector 85.

When the releasable member 67 is in the latched position shown in FIGS. 2 and 3, the circuit breaker may be manually operated by operation of the operating member 43. Movement of the operating member 43 in a clockwise direction from the "on", or closed position, seen in FIG. 2 to the "off", or open position, seen in FIG. 3 carries the upper end of the contact arm 41 to the left of the line of action of the spring 71, whereupon the spring acts to move the contact arm 41 with a snap action to the open position seen in FIG. 3. As can be understood by reference to FIGS. 2 and 3, the spring 71 biases the contact arm 41 upward into engagement with the operating member 43 so as to bias the operating member 43 against the lower edges of the projection 47 about which the operating member 43 pivots. Movement of the operating member 42 in a counterclockwise direction from the "off" position (seen in FIG. 3) to the "on" position (seen in FIG. 2) moves the upper end of the switch arm to the right of the line of action of the spring 71, thereby to move the contact arm 41 to the closed position seen in FIG. 2.

The trip device 29 comprises an elongated bimetal 77. The bimetal 77 is a flat member that is secured, at the upper end thereof, to a flat leaf spring 91 that is secured to a projection 93 of the stationary frame 25. Frame 25 is a flat member that is secured in place in the housing between projections of the molded insulating housing, and the projection 93 is bent over extending in a direction generally normal to the plane of the flat supporting plate 25. The flat spring is fixedly secured to the projection 93 so as to support the bimetal 77. An elongated rigid magnetic armature latch member 95 is welded, at 97, to the high expansion side of the bimetal 77. The armature 95 extends upward along the high expansion side of the bimetal 77 and it is in a parallel relationship with the bimetal 77 when the bimetal is in the cold, or straightened condition. The armature 95 encounters a window opening having a latch surface at its base. The latch end 69 of the releasable member 67 is formed with a latch surface 103 thereon and a stop surface or fulcrum part thereon. A surface portion 107 of the armature 95 serves as a stop part to engage the fulcrum part 105 of the releasable member 67 in the latched position of the releasable member. A rigid magnetic member 109 is supported in the housing 13 between insulating portions 111 which form slots in which the magnetic member 109 is positioned. The projections 111 (FIG. 4) limit movement of the magnetic member 109 in the plane of the paper, and the housing limits movement of the magnetic member 109 in a direction normal to the plane of the paper.

The circuit breaker is shown in FIG. 2 in the reset position wherein the releasable member 67 is latched on the armature 95. The circuit breaker can be manually operated only when the releasable member 67 is in the reset or latched position. In the position seen in FIG. 2, the supporting spring 91 biases the bimetal 77 to the left toward the releasable member 67 which movement is limited by the engagement of the stop part 107 of the rigid armature 95 with the stop part or fulcrum part 105 of the rigid releasable member 67. In this position, the latch surface 103 of the releasable member 67 rests on the latch surface 101 of the armature 95 to latch the releasable member 67 preventing clockwise movement of the releasable member 67 about the pivot 65. The high expansion side of the bimetal 77 is on the left as seen in FIG. 2. Upon the occurrence of a sustained lesser overload current above a first predetermined value, the bimetal 77, which is heated by the current flowing therethrough, deflects from the position seen in FIG. 2 to the thermally-tripped position seen in FIG. 5. The bias of the spring 91 of the complete bimetal 77 toward the left is such that the spring 91 maintains the bias of the part 107 of the armature 95 against the fulcrum part 105 of the releasable member 67 during the deflection of the bimetal 77 to the thermally-tripped position. The bimetal 77 deflects to a curvature during which movement the rigid armature 95 is at an angle with the lower end of the rigid armature 95 being carried by the lower end of the bimetal 77, while the armature 95 moves about the fulcrum part 105 with a levering action to move the latch surface 101 of the armature 95 free of the latch surface 103 of the releasable member 67, thereby to release the releasable member 67. When the releasable member 67 is released, the spring 71 acts to rotate the releasable member 67, in a clockwise direction, about the pivot 65 until the releasable member 67 is stopped by engagement thereof with a molded projection 117 on the housing. During this movement, the line of action of the spring 71 moves to the right of the pivot 55, 51, whereupon the spring 71 biases the contact arm 41 in opening direction and moves the contact arm 41 so that the line of action of the force exerted by the spring on the operating member 43 shifts across the pivot 45, 47 and actuates the operating member 43 to the tripped position shown in FIG. 4. The tripped position of the operating member 43 is intermediate the "on" and "off" positions. The operating member 43 is stopped in the intermediate or tripped position seen in FIG. 4 when an insulating projection 119 thereon engages the projection 75 on the releasable member 67. The contact arm 41 is stopped in the open position seen in FIG. 4 when it engages an insulating projection 121 molded integral with the housing. Positive separation of the contacts is provided during a tripping operation by means of a projection 123 extending from the releasable member 67. If the contacts are slow in opening due to sticking, drag or other reasons, the projection 123 engages the inner edge of the contact arm 41 to start the contact arm in opening direction.

The circuit breaker is trip-free in that the breaker will automatically trip open even if the handle 57 is held in the closed position.

Following a tripping operation, it is necessary to reset the breaker before the breaker can be operated. This is accomplished by moving the operating member 43 from the tripped position (FIG. 4) slightly beyond the full "off" position. During this movement, the projection 119 on the operating member 43 operates against the projection 75 of the releasable member 67 to move the releasable member 67 counterclockwise to a position wherein the latch surface 103 of the releasable member 67 is just above the latch surface 101 of the armature 95 whereupon the spring 91 moves the bimetal 77, which cools and straightens when in non-current carrying tripped condition, and moves the armature 95 toward the releasable member to latch the trip member in the initial operating position shown in FIG. 3. With the releasable member 67 reset in the operating position, the circuit breaker can be manually operated in the same manner as was hereinbefore described.

The circuit breaker is instantaneously tripped upon the occurrence of a short circuit or severe overload current above a second predetermined value, higher than the first predetermined value, by operation of the magnetic trip of the trip means 29. As can be understood with reference to FIG. 2, the current passing through the bimetal 77 generates magnetic flux which operates through the armature 95, the air gaps between the armature 95 and the magnetic member 109, and through the stationary magnetic member 109. When the current reaches the second predetermined value, the magnetic flux is strong enough to attract the armature 95 toward the stationary magnetic member 109, and the spring 91 flexes permitting the armature 95 and bimetal 77 to move as a unit to the magnetically-tripped position seen in FIG. 4 wherein the releasable member 67 is released to trip the breaker in the same manner as was hereinbefore described. Following a magnetic tripping operation, the circuit breaker is reset and relatched in the same manner as was hereinbefore set forth with regard to the time-delay thermal tripping operation. The bimetal 77 and armature 95 are shown in the attracted position in FIG. 4. It can be understood that, when the circuit is interrupted, the armature 95 will no longer be attracted to the stationary magnetic member 109 and the spring 91 will return the bimetal 77 and armature 95 to the unattracted position.

Figure 5:
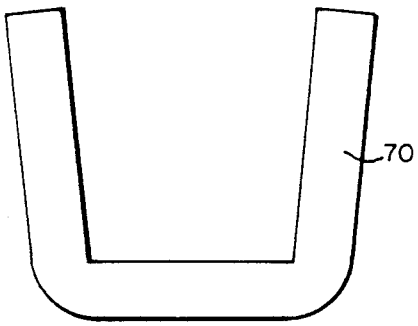
FIGS. 5 and 6 are illustrating two lateral views at 90 degrees from one another of the U-shaped member of FIG. 2.
Figure 6:
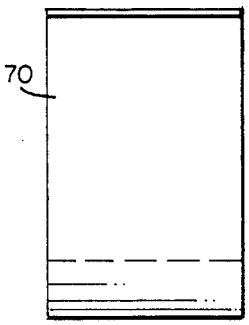

Referring to FIGS. 2, 5 and 6 the circuit breaker includes a ferro-magnetic U-shaped member 70 (not shown in FIGS. 3 and 4, for the sake of clarity in describing the arc chamber) which is used for its arc-extinguishing function when the circuit breaker is mounted with AC terminals. A view of the U-shaped member is given in FIG. 5 as seen in a plane parallel to the cross-section of the U with its two opposite quasi-parallel extensions 101 and 102 from a bight portion 103, whereas FIG. 5 shows the U-shaped member laterally looking toward the central plane. It is understood from U.S. Pat. No 4,266,210 that the channel defined by the two extensions 101 and 102 is centered on the plane of thc arc chamber, and that the movable contact trajectory is in that plane. In U.S. Pat. No. 4,266,210 are shown two U-shaped members placed side-by-side along the arc chamber, but not contiguous, in order to create therebetween a small airgap which improves substantially the arc extinguishing function. The present invention is effective with such two U-shaped members as well. In that case, the projection of the arc chamber being the same, the magnet MGN placed on the outside of the housing as shown in FIGS. 1A and 1B would encompass at least the lateral projection of two U-shaped members instead of one, since the arc chamber is intended to define the active area.

Although a single magnet is assumed in FIGS. 1A and 1B to be placed on the housing, it is also understandable that two identical magnets can be placed, one on each side of the housing with the same laterally projected area. In such instance, the two magnetic fields, so generated separately, will concur in a common result across the arc chamber.

It is also observed that for DC operation, the user is bound by the polarity of the magnet as installed. However, by identifying on the housing with a sign (+ or −), or an arrow, which of the two terminal polarities belong to the right terminal connection when installing the circuit breaker on the line, the user will be insured that the benefit of the DC current arc extinguishing function is obtained.

We claim:

1. A circuit breaker including: an insulating housing, separable electrical contacts within the housing and a mechanism for actuating said contacts relative to one another under a command for electrical breaking through the mechanism; the housing having two opposite side-walls; the contacts being centered for relative movement in a central plane parallel to said sidewalls;

with the provision of at least one U-shaped member of ferro-magnetic material defined by two opposite outer lateral surfaces and two opposite inner lateral surfaces, said U-shaped member being disposed in the housing with said outer lateral surfaces being mounted adjacent to the corresponding sidewalls of the housing and with said inner lateral surfaces being symmetrically placed on opposite sides of said central plane, whereby said U-shaped member defines about said parallel plane a common arcing region for the arc generated by said contacts when separating;

one magnet being mounted upon one of said sidewalls of the housing, said magnet having a polar area substantially equal to the area laterally projected upon said sidewall by said common arcing region, and said magnet having a polar orientation so selected in relation to the electric arc as to generate across said arcing region a magnetic field effective to have a quenching effect when the circuit breaker is operating under a DC voltage;

whereby the circuit breaker is operable with an AC voltage under said U-shaped member, and with a DC voltage under said magnet.

2. The circuit breaker of claim 1 with said magnet being made of ceramic material.

3. The circuit breaker of claim 2 with said magnet being glued to the associated housing sidewall.

4. The circuit breaker of claim 3 with two magnets being provided upon said housing, each magnet being associated with a corresponding one of the housing sidewalls and each having the same projected area, the respective polar orientations being in relation to the direction of DC current in the arcing region as seen from such magnet.

5. The circuit breaker of claim 3 with the provision of at least two U-shaped members of ferromagnetic material mounted in said housing side-by-side relative to said common plane and in said arc region, both being disposed adjacent to said two sidewalls;

said U-shaped members being spaced from one another so as to define an airgap therebetween and so as to generate an arc gap in the middle of the electric arc generated in the arc region when the electrical contacts are separating under the mechanism;

one common magnet being provided mounted upon one of said housing sidewalls and in association with the two U-shaped members, the polar area of said magnet being coextensive with the projected area of said arc region on the sidewall of the housing.

6. The circuit breaker of claim 5 with two magnets being associated side-by-side upon said housing and operating as said common magnet through one common housing sidewall.

7. The circuit breaker of claim 5 with two common magnets being associated with opposite housing sidewalls.

* * * * *